US005517703A

United States Patent [19]

Ouelette

[11] Patent Number: 5,517,703

[45] Date of Patent: May 21, 1996

[54] SPA COVER LIFT

[76] Inventor: Roger J. Ouelette, P.O. Box 10451, Vernon, N.Y. 13476

[21] Appl. No.: 356,451

[22] Filed: Dec. 14, 1994

[51] Int. Cl.[6] ..... E04H 4/08

[52] U.S. Cl. ..... 4/498

[58] Field of Search ..... 4/494, 498

[56] References Cited

U.S. PATENT DOCUMENTS

| | | |
|---|---|---|
| 1,106,228 | 8/1914 | Lee . |
| 2,912,703 | 11/1959 | Murphy . |
| 3,002,195 | 10/1961 | Prudek . |
| 3,051,964 | 9/1962 | Fisher et al. . |
| 3,094,710 | 8/1963 | Hoke . |
| 3,209,373 | 10/1965 | Meredith et al. . |
| 3,490,642 | 1/1970 | Friedlander . |
| 3,854,149 | 12/1974 | Mischke . |
| 3,889,843 | 6/1975 | Miller . |
| 4,083,596 | 4/1978 | Robertson . |
| 4,135,159 | 1/1979 | Kubanoff . |
| 4,422,192 | 12/1983 | Jacobs . |
| 4,593,873 | 6/1986 | Nelson . |
| 4,691,957 | 9/1987 | Ellingson . |
| 4,821,902 | 4/1989 | May . |
| 4,853,985 | 8/1989 | Perry . |
| 4,964,669 | 10/1990 | Geier . |
| 5,048,153 | 9/1991 | Wall et al. . |
| 5,131,102 | 7/1992 | Salley et al. . |

FOREIGN PATENT DOCUMENTS

| | | |
|---|---|---|
| 1167738 | 4/1964 | Germany . |
| 3416889 | 11/1985 | Germany . |

*Primary Examiner*—Charles E. Phillips
*Attorney, Agent, or Firm*—Harris Beach & Wilcox

[57] ABSTRACT

A lifting mechanism for removing and restoring a hinged spa cover from the spa tub. Two tubular brackets are cojoined so that base members on the brackets are parallelly aligned adjacent to one end of the spa and arms on the brackets extend along opposite sides of the spa. The cojoined base members are pivotally mounted so that the lifting arms are rotatable between a first lowered position and a second raised position. Support beams are connected to the lifting arms over which the hinged sections of the cover are foldable when the arms are in the first position allowing the cover to be lifted clear of the spa when the arms are moved to the second raised position.

13 Claims, 6 Drawing Sheets

SPA COVER LIFT

BACKGROUND OF THE INVENTION

This invention relates to a lifting mechanism for removing the cover from the top of a heated spa and, in particular, to a light-weight lifting mechanism capable of removing a heavy spa cover with a minimum amount of distortion of the lifting members.

The use of outdoor spas or hot tubs has become widespread, particularly in warm climate regions. Most outdoor spas are equipped with covers which serve to prevent debris and the like from contaminating the tub water when the spa is not in use. In addition, the covers are also designed to retain heat and thus maintain the bath water temperature at a desired level. As a consequence, spa covers tend to be relatively heavy devices that are difficult to install and remove from the tub.

Lifting devices have been developed to aid in the covering and uncovering of spas and hot tubs which can be operated with varying amounts of difficulty by a single individual. One such lifting device is disclosed in U.S. Pat. No. 5,048,153 to Wall et al. and another is disclosed in U.S. Pat. No. 5,131,102 to Salley et al. In both of these prior art devices, a pair of pivotally mounted opposed arms are arranged to engage the tub cover and simultaneously lift the cover and swing it clear of the tub, thereby uncovering the tub to provide unhindered use of the spa. The cover remains in engagement with the lifting mechanism when the tub is being utilized and the mechanism is again brought into play to restore the cover to a closed position when the tub is not being used.

Although these prior art devices provide a mechanical advantage that allows one person to remove and restore a heavy spa cover, the structural frame members of the device, nevertheless, tend to bend or become distorted when the lifting frame is placed in operation. Because most spas are relatively large or bulky, an individual is usually able to pull against only one side of the frame during the covering or uncovering operation. This places a high bending moment or torque upon the frame components causing the frame to twist. This results in one side of the cover being lifted before the other producing unwanted rubbing between the cover and the lifting frame components. As can be seen, this constant bending of the lifting frame components causes undue fatigue on the distorted member leading to early equipment failure and costly repairs.

SUMMARY OF THE INVENTION

It is therefore an object of the present invention to improve lifting devices used in removing and replacing heavy covers on spas or hot tubs.

It is a further object of the present invention to reduce the amount of distortion produced in the frame of a spa cover lifting mechanism.

It is a still further object of the present invention to provide a lightweight tubular structure for a spa cover lifting mechanism that will resist bending when the cover is removed or replaced on the tub.

Another object of the present invention is to provide a lifting mechanism for a spa cover that will minimize rubbing damage to the cover during the removal and replacing of a spa cover.

Yet another object of the present invention is to provide a high strength, light-weight frame for lifting a spa cover which can be easily operated by one person.

A still further object of the present invention is to provide a high strength, light-weight, fully adjustable spa cover lift that will resist twisting when placed in operation.

These and other objects of the present invention are attained by means of apparatus for lifting the hinged cover of a spa to facilitate removal and replacement of the cover. The apparatus includes a pair of tubular L-shaped units, each having a base member and a lifting arm. The base members of the two units are pivotally mounted in parallel alignment adjacent to one end wall of the spa with the lifting arms extending outwardly to either side of the spa to create a lifting frame. Support beams are mounted in the distal end of each lifting arm with the beams being located adjacent to and parallel with the cover hinge when the lifting frame is placed in a first lowered position. The cover is folded over the beams and the frame is then rotated to a second raised position wherein the cover is suspended in a raised upright position adjacent to the end wall of the spa.

A foot actuated lever is centrally attached to the base of the lifting frame to assist in lifting the frame to the raised position. The lever also provides a stand upon which the lifting mechanism rests when the frame is in the raised position.

BRIEF DESCRIPTION OF THE DRAWINGS

For a better understanding of these and other objects of the present invention, reference is had to the following detailed description of the invention which is to be read in association with the accompanying drawings, wherein.

DESCRIPTION OF THE INVENTION

Figure 1:
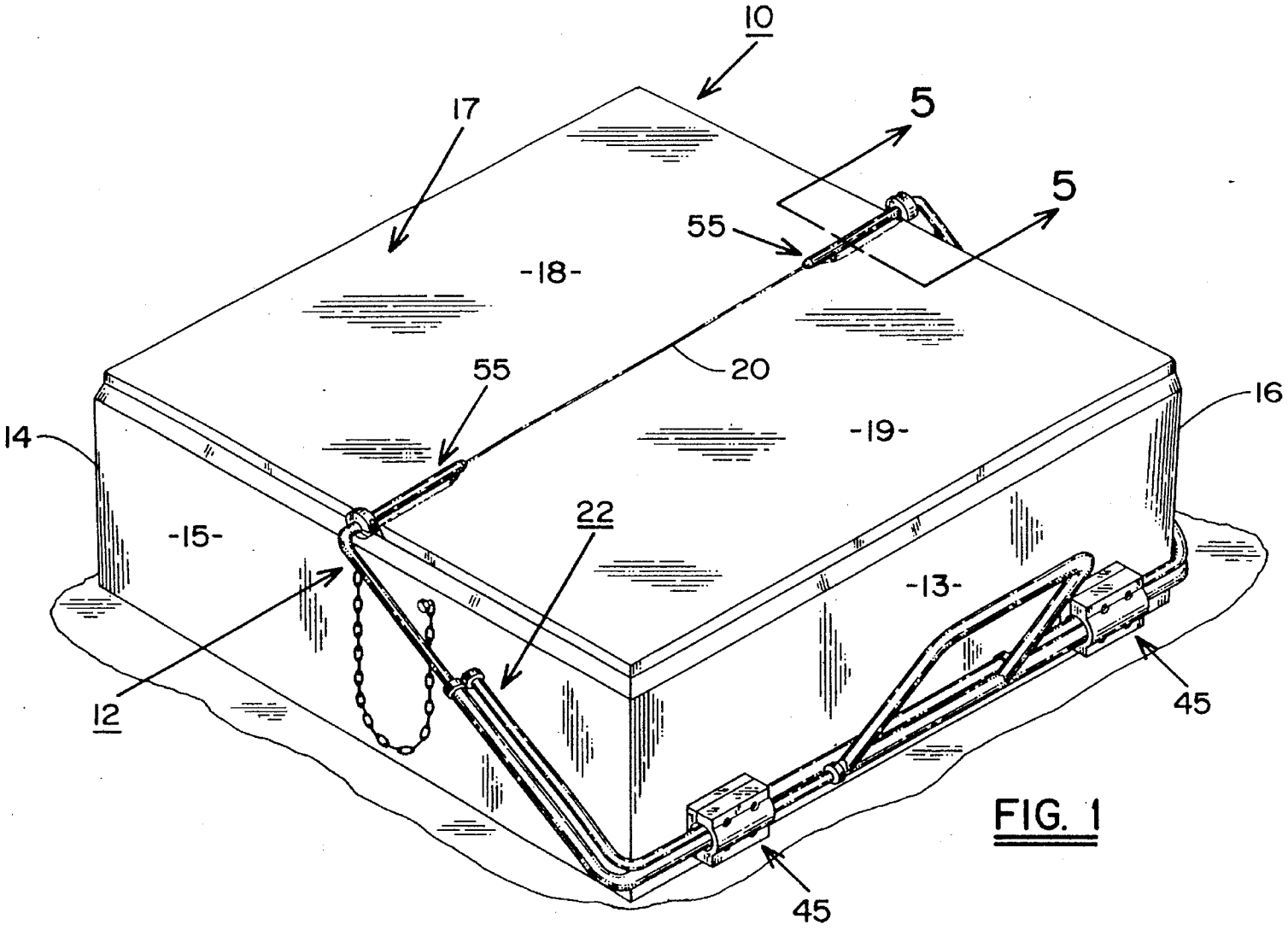
FIG. 1 is a perspective view showing a spa equipped with a lifting mechanism embodying the teaching of the present invention.

Referring initially to FIG. 1, there is shown an above-ground spa or hot tub, generally referenced 10, that includes a lifting mechanism 12 embodying the teachings of the present invention. Although the hot tub can take any one of many shapes, the instant spa is shown rectangular in form and includes a pair of raised end walls 13 and 14 and a pair of raised side walls 15 and 16. The top of the spa is closed by a cover 17, containing two half-sections 18 and 19 that are joined by means of a hinge 20. The cover contains a layered construction that both insulates the tub to prevent heat loss as well as protecting the interior of the tub from contamination when the cover is closed over the tub. As a consequence, the cover is typically relatively heavy and difficult to remove and replace from the top of the tub.

Conventionally, lifting mechanisms shown are available for use with most spas which have sufficient mechanical advantage to enable a single person to remove and replace the cover. As noted above, however, most of these devices are formed of light-weight loosely joined components so that the lifting frame bends or becomes distorted under the weight of the cover. This, in turn, causes structural wear and fatigue on the parts leading to early failure and costly repairs.

The present lifting frame utilizes light-weight tubular members that are brought together in such a manner that the frame is able to resist high torque producing loads when the frame is placed in operation.

Figures 2, 3, 4:
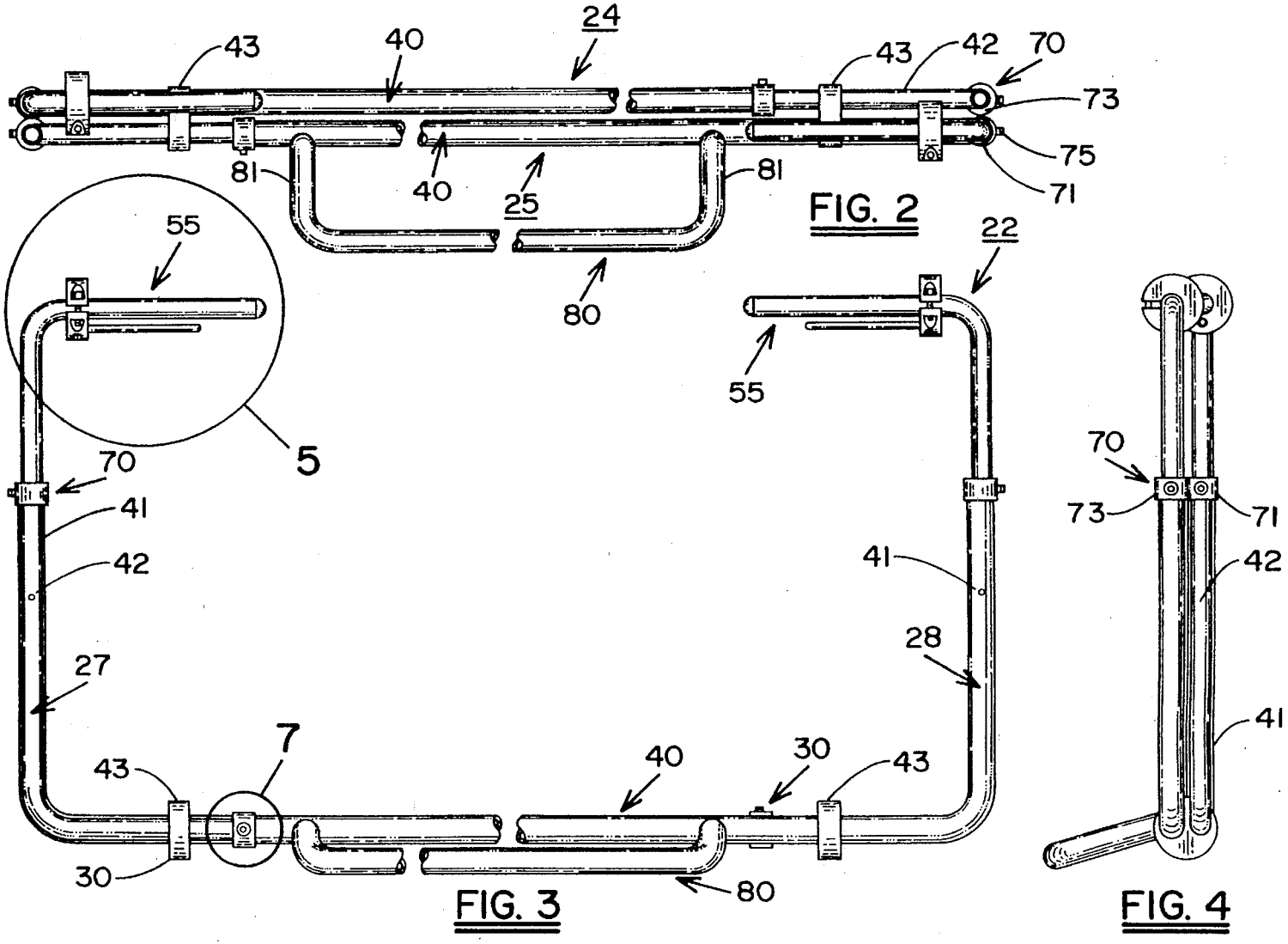
FIG. 2 is an enlarged top view of the lifting mechanism of the present invention.
FIG. 3 is a side elevation of the lifting mechanism shown in FIG. 2.
FIG. 4 is an end view of the lifting mechanism shown in FIG. 3

The lifting mechanism of the present invention is shown in greater detail in FIGS. 2–4. The mechanism includes a lifting frame 22 made up of two U-shaped brackets that includes an inner bracket 24 and an outer bracket 25 (FIG. 2). The brackets are mounted in assembly in adjacent parallel alignment. As will be explained in greater detail below, the two brackets are secured in adjacent parallel relationships by means of a pair of rotors 43—43 and a pair of end couplings 70—70. Each bracket further includes a first small diameter L-shaped member 27 that is telescoped inside a large diameter L-shaped member 28 so that the brackets can be laterally adjusted to accommodate the frame to various sized spas.

Figure 7:
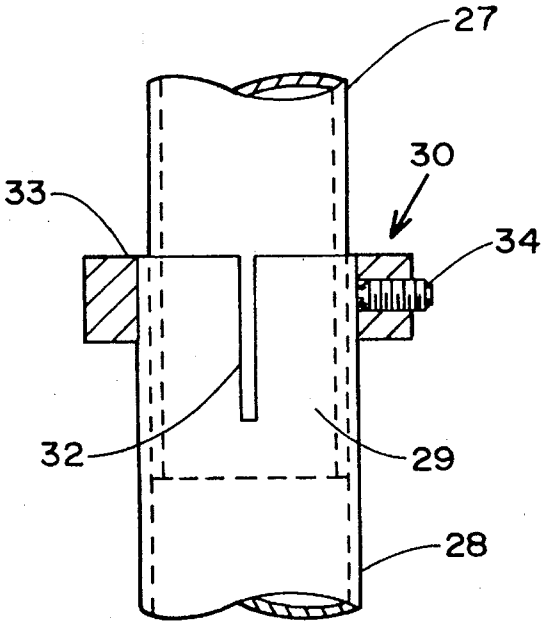
FIG. 7 is an enlarged view taken along lines 7—7 in FIG. 3, showing a split collar arrangement used in the present invention.

A locking unit 30 is located at the joint where bracket 27 is slidably received within the larger bracket 28. As best illustrated in FIG. 7, the receiving end 29 of the larger diameter member 28 contains one or more axially disposed slits or grooves 32 over which is slipped a locking collar 33. The locking collar is equipped with one or more set screws 34 that are tightened down in assembly against the split section or sections of the receiving end of member 28 to force the split end of the outer member into secure locking contact against the inner member. Once the frame brackets have been adjusted and the brackets locked in place, a high strength unitized structure capable of resisting high bending forces is established.

Figure 8:
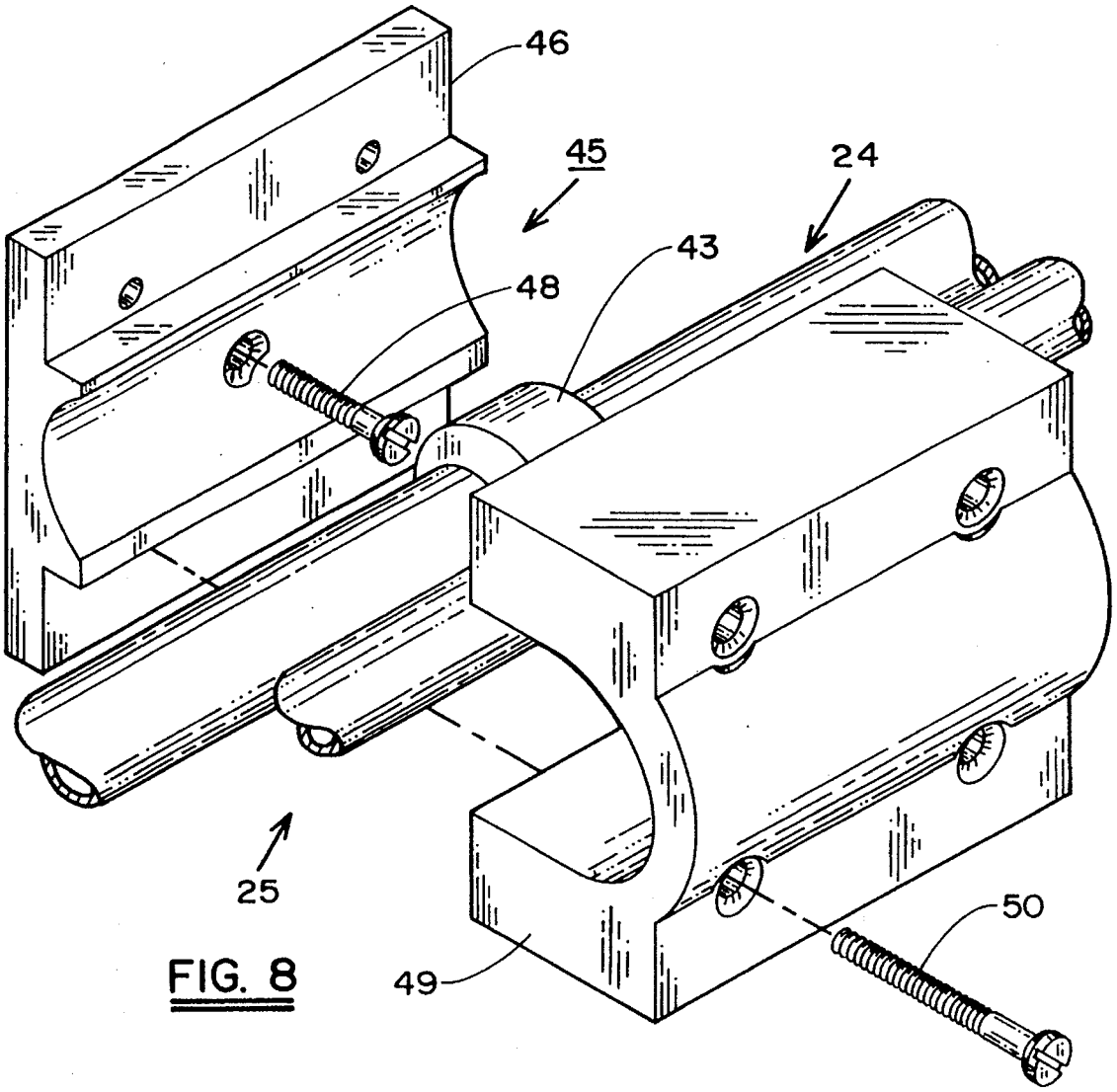
FIG. 8 is an exploded view in perspective showing the bearing block assembly for rotatably supporting the present lifting frame in assembly.

The two U-shaped brackets are of similar construction and each includes a base 40; and a pair of opposed upraised arms 41 and 42. In assembly, the two brackets are mounted in face to face relationship with the larger diameter lifting arms 41 of one bracket positioned adjacent to the smaller diameter torque resisting arm 42 of the other bracket. As noted above, the base sections of the two aligned brackets are locket together by a pair of spaced apart rotors 43—43. As illustrated in FIG. 8, each rotor is pivotally supported in a bearing block generally referenced 45. The bearing block contains a base plate 46 that is secured to end wall 13 of the spa 10 (FIG. 1) by means of threaded fasteners 48 or the like. A cap 49 is secured to the base plate via screws 50 to close the assembly. When closed, the assembly provides a circular bearing seat 51 for rotatably containing the rotor 43 thus allowing the frame to swing about a horizontal axis defined by the coaligned rotor axes adjacent to the end wall of the spa.

Figure 6:
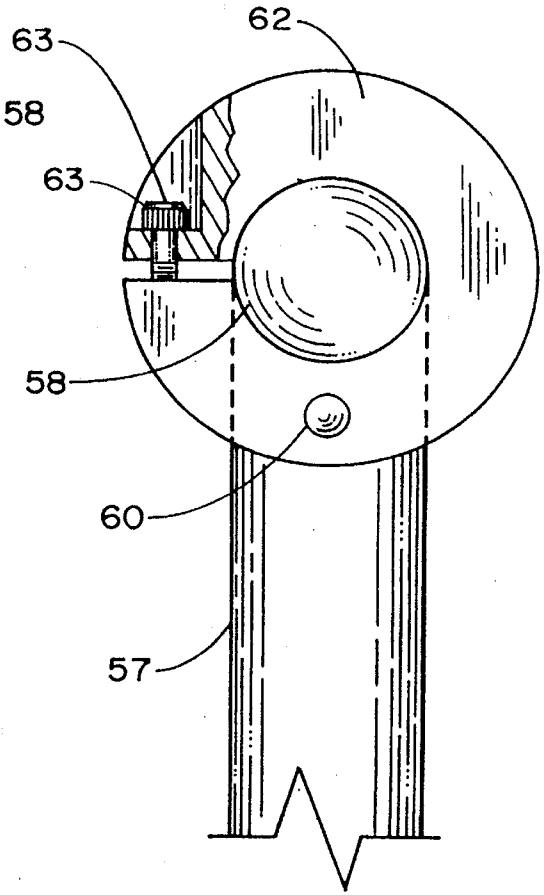
FIG. 6 is an end view of the lifting beam shown in FIG. 5.
Figure 5:
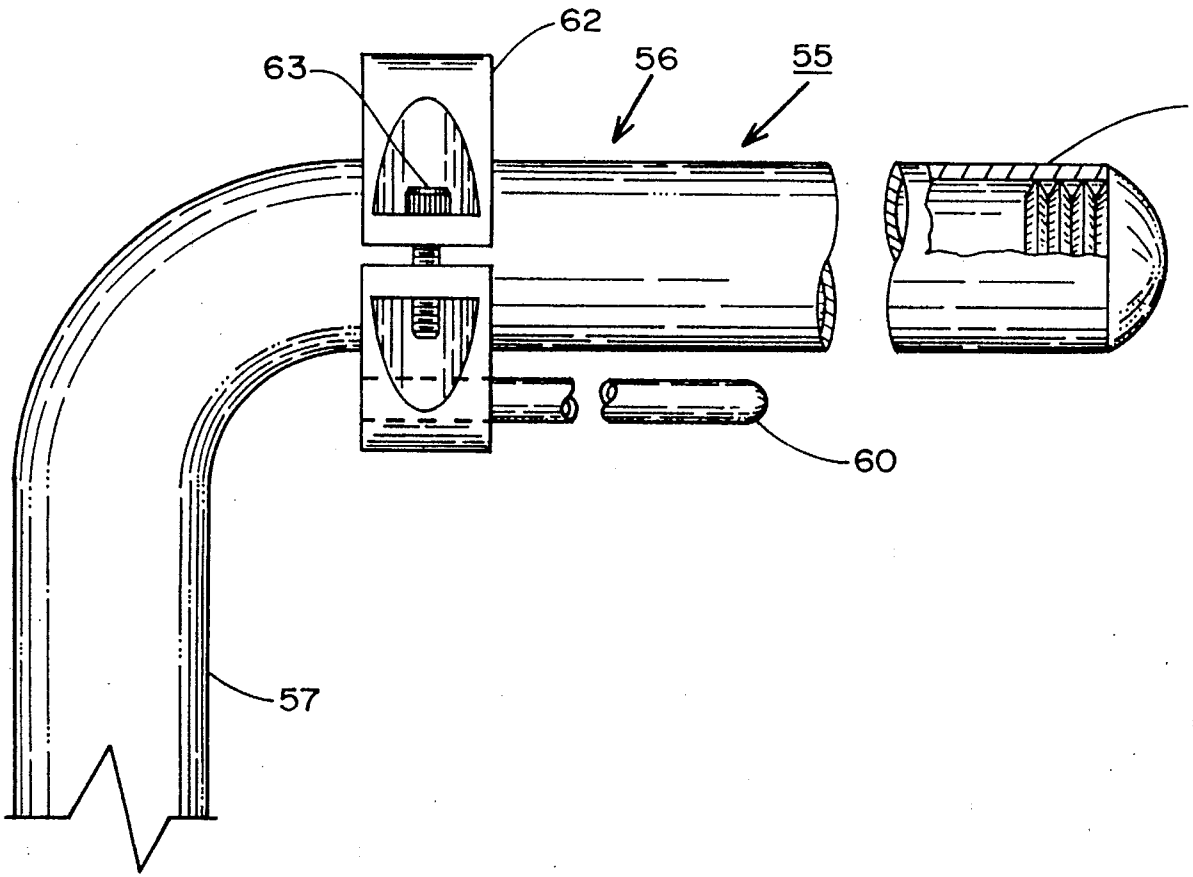
FIG. 5 is a partial enlarged view showing one of the lifting beams utilized in the lifting frame of the present invention.

A cover supporting unit 55 is adjustably supported in the top of each lifting arm. The cover supporting unit is shown in greater detail in FIGS. 5 and 6 and includes an L-shaped element 56. The element contains a vertically disposed leg 57 and a horizontally disposed beam 58. The leg is slidably received in the distal end of the associated lifting arm. As will be explained in greater detail below the frame is adjusted at a desired elevation so that the beam is adjacent to and parallel with the cover hinge when the lifting frame is placed in the first lowered position. When in the first position, the beam extends at least 18 inches along the length of the hinge.

Figure 10:
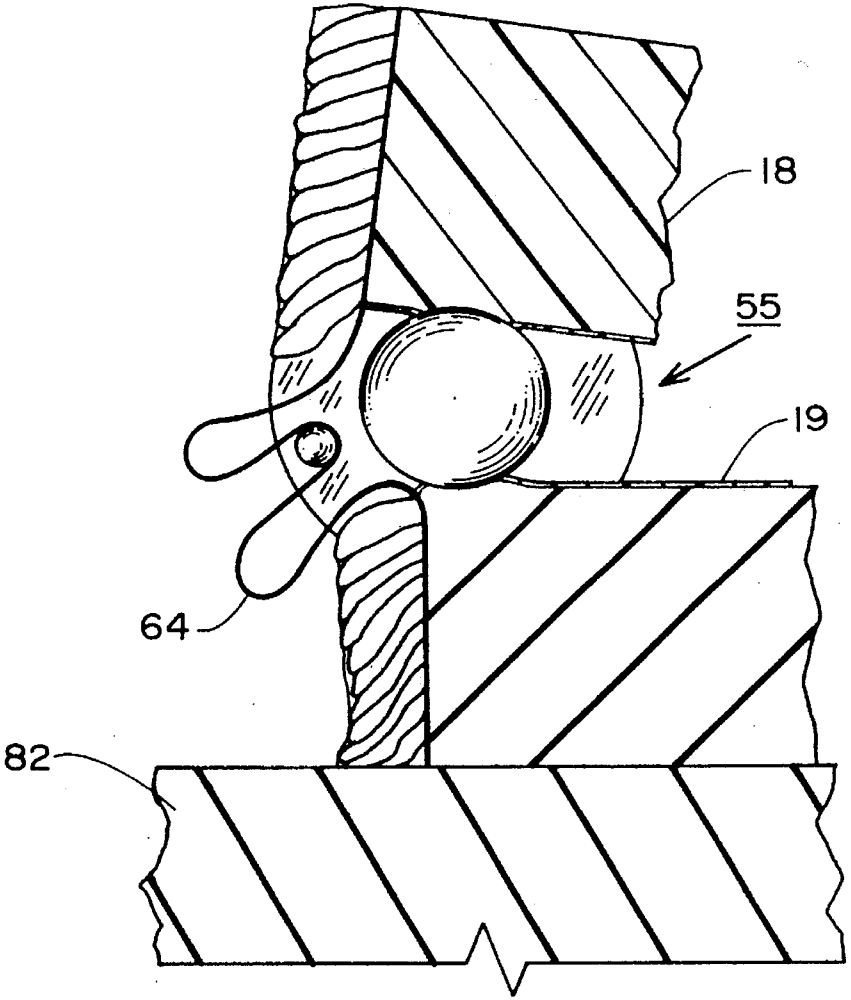
FIG. 10 is a view similar to that of FIG. 9 showing the spa cover folded over the lifting beam.
Figure 9:
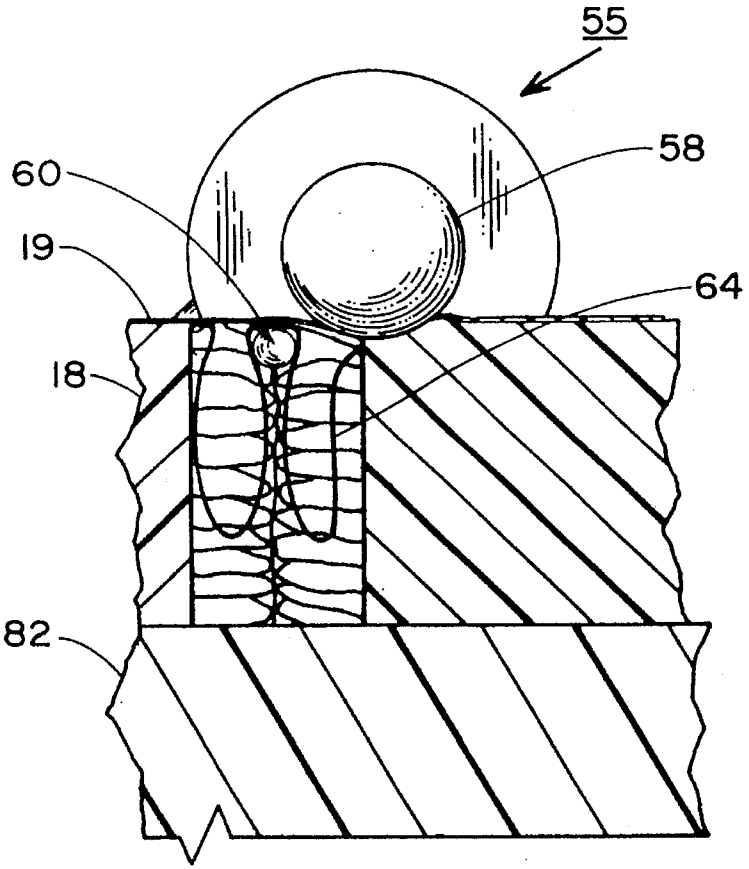
FIG. 9 is an enlarged side elevation in section showing the lifting beam of the present invention in a first lowered position, parallel to the hinge of a spa cover.

A locating pin 60 is mounted beneath the beam. The pin is pressfitted into the hub of a split collar 62 which, in turn, is locked to the beam by tightening down upon set screw 63. The pin is located in the hub so that it can be slipped beneath the accordion pleat 64 that extends along the length of the cover half section (FIGS. 9 and 10). The pins, when placed under both sides of the pleat, help to position the lifting arms in assembly and serve to prevent the cover from being raised by the lifting mechanism prior to the half sections being folded over the beam.

Each cover supporting unit is adjustably supported in one of the lifting arms by means of a coupling 70. The coupling serves to connect the adjacent arms of the two aligned brackets 24 and 25 of the lifting frame in assembly and also adjustably locks one of the lifting bar assemblies in an associated lifting arm. The annular ring section 71 that surrounds the torque arm and a locking collar section 73 that surrounds the adjacent lifting arm. The locking collar section is attached to the distal end of the lifting arm in the same as locking collar 30 described above. The annular ring section is locked in place against the torque arm by means of a set screw 75.

When both couplings are locked in place in assembly, the torque arm of each bracket is securely locked to the lifting arm of the opposite bracket. This, in turn, with the aid of the locking collars 30—30, holds the component parts of the lifting frame in a rigidly unitized assembly that will not bend or twist when it is placed under load during a spa cover lifting operation.

Figure 11:
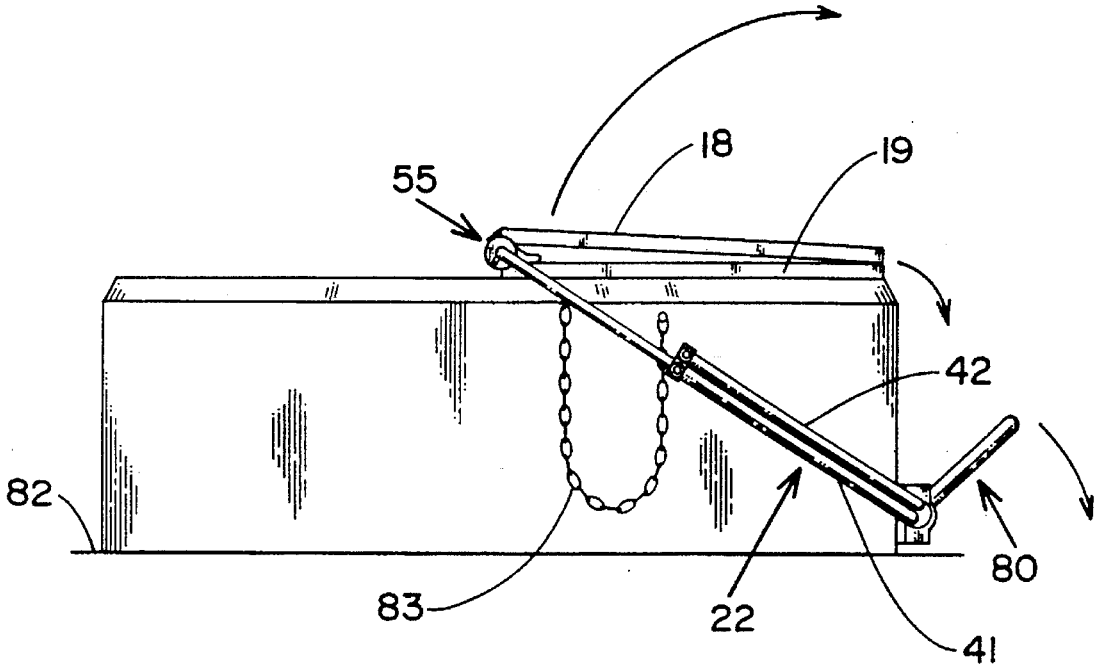
FIG. 11 is a side view of a spa incorporating the present lifting mechanism in a first lowered position with the cover folded over the lifting beams.
Figure 12:
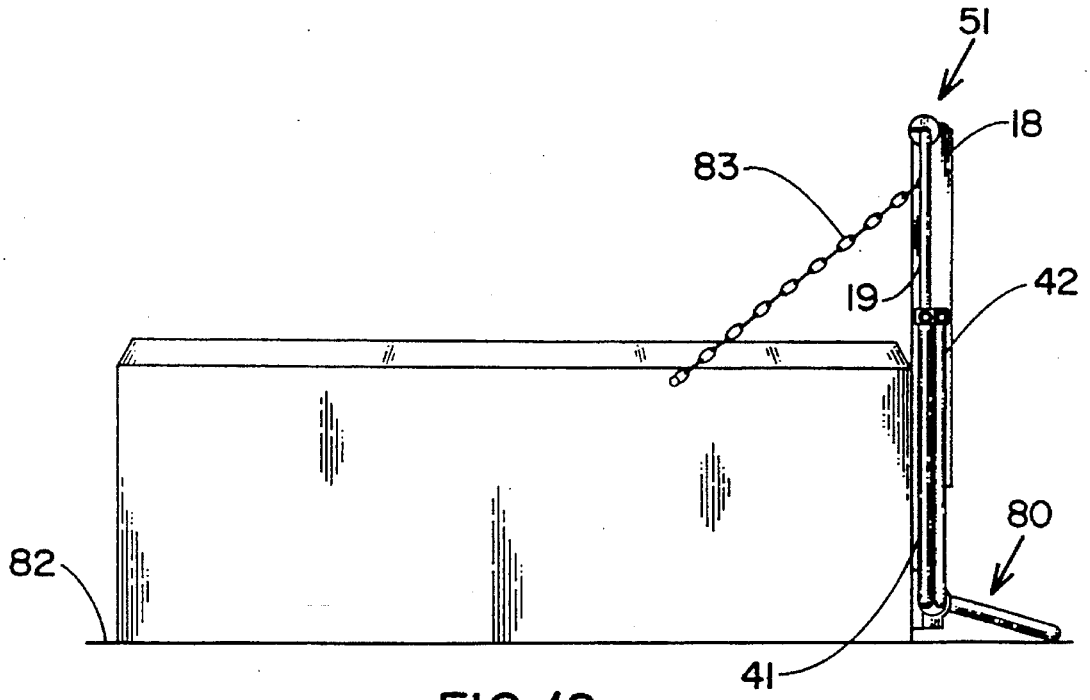
FIG. 12 is a side view of the spa showing the lifting frame in a second raised position adjacent the spa.

With further reference to FIGS. 11 and 12, the lifting mechanism 22 of the present invention is shown in the first lowered position in FIGS. 9 and 11 with the safety pins 60 located inside the hinge pleat of the cover hinge and the lifting beams 58 aligned along the hinge. The two half sections of the cover are then folded over the beams as shown in FIGS. 10 and 11. The lifting mechanism is now in condition to remove the cover from the spa.

To remove the cover, the lifting frame is rotated upwardly and rearwardly in the bearing blocks. A foot actuated lever 80 has opposed arms 81 that are secured to the base section of the outer lifting frame bracket 25. The lever is a U-shaped member that is welded or otherwise connected to the bracket at a desired angle so that it can be depressed when the frame is in the first lowered position. To move the frame into the second raised position, the user grasps one side of the frame and steps down on the lever. Because of the rigidity of the frame, the frame raises the spa cover without twisting or bending.

When the lifting arm reaches the second raised position as shown in FIG. 12, the foot lever is seated upon the spa deck 82 and thus provides a rest for supporting the lifting frame and the cover attached thereto in a raised position adjacent the spa. A safety chain 83 may be attached between the lifting frame and a side wall of the spa to insure that the frame will not over rotate in a high wind.

While this invention has been explained with reference to the structure disclosed herein, it is not confined to the details set forth and this invention is intended to cover any modifications and changes as may come within the scope of the following claims:

What is claimed is:

1. Apparatus for lifting a spa cover having two sections that are connected by a hinge so that the sections are foldable one over the other, said apparatus including a first U-shaped bracket and a second U-shaped bracket, each bracket having a base member, an upraised lifting arm joined to one end of the base member and an opposed upraised torque resisting arm also secured to the other end of the base member connecting means for joining the two brackets in parallel alignment with the lifting arm of one bracket adjacent to the torque resisting arm of the other bracket, pivot means for rotatably supporting the base of each of the aligned brackets adjacent to an end wall of a spa and the arms of said aligned brackets being positioned adjacent to opposed side walls of said spa wherein the joined brackets are rotatable in unison between a first lowered position and a second raised position, cover supporting means connected to the upper end of each lifting arm, said supporting means passing over a hinge of a spa cover mounted upon said spa adjacent to and parallel with the cover hinge when the cojoined brackets are in the first, lowered position, whereby the cover is foldable over the supporting means and is lifted clear of the spa when the cojoined brackets are rotated into the second raised position.

2. The apparatus of claim 1 wherein each cover support means further includes an L-shaped member having a vertical leg adjustably contained within one of the lifting arms and a horizontal beam that passes over the spa cover adjacent to and parallel with the cover hinge.

3. The apparatus of claim 2 wherein said support means further includes a locating pin joined to said vertical leg that is arranged to pass under the hinge of the spa cover.

4. The apparatus of claim 1 that further includes a foot operated lever means joined to one of the base members for assisting in rotating the torque tubes within the pivot means.

5. The apparatus of claim 4 wherein said foot lever means is a U-shaped tubular member having two opposed connecting arms that are joined to the base members.

6. The apparatus of claim 1 wherein each bracket is formed of two L-shaped members wherein one member is slidably received within said other member.

7. The apparatus of claim 6 wherein said cover supporting means are adjustably contained within the lifting arm of each bracket.

8. The apparatus of claim 1 wherein said base members are cojoined by a pair of spaced apart rotors and further including a bearing block for rotatably housing each of said rotors adjacent to said end wall of said spa.

9. Apparatus for lifting a spa cover having two sections that are connected by a hinge so that the sections are foldable one over the other, said apparatus including:

a lifting frame that includes a pair of U-shaped tubular brackets each having a base member and opposed extended arms that includes a lifting arm and a torque arm, means for cojoining the two tubular brackets in adjacent parallel alignment so that the lifting arms are positioned on either side of the frame, pivot means for rotatably supporting the cojoined base members adjacent to an end wall of a spa and the extended arms adjacent to opposite side walls of the spa whereby the extended arms can be rotated between a first lowered position and a second upraised position, cover support means connected to a first extended arm of one bracket on one side of the frame and to a second extended arm of the other bracket on the other side of the frame, and each support means including a leg slidably contained within one of said lifting arms and a beam that at least partially extends from said arm over a hinged spa cover adjacent to and parallel with said spa cover hinge when the frame is in said first lowered position whereby the cover is foldable over said beams and is lifted clear of said spa when the frame is pivoted to the second raised position.

10. The apparatus of claim 9 wherein said support means are adjustably contained in said arms.

11. The apparatus of claim 10 that further includes a locking collar for compressing the lifting arms into holding contact against the support means.

12. The apparatus of claim 9 wherein said pivot means further includes spaced apart rotor means mounted upon the base members of the brackets and bearing blocks for journalling said rotor means adjacent to said end wall of said spa.

13. The apparatus of claim 9 that further includes a foot actuated lever means connected to one of said base members of the frame between the rotor means for assisting in the rotation of the units between the first and second positions.

* * * * *